US006918785B1

(12) United States Patent
Reilly

(10) Patent No.: US 6,918,785 B1
(45) Date of Patent: Jul. 19, 2005

(54) ELECTRICAL CONNECTOR

(75) Inventor: Joseph M. Reilly, Wichita, KS (US)

(73) Assignee: M-Pyre, L.L.C., Wichita, KS (US)

( * ) Notice: Subject to any disclaimer, the term of this patent is extended or adjusted under 35 U.S.C. 154(b) by 0 days.

(21) Appl. No.: 10/858,278

(22) Filed: Jun. 1, 2004

(51) Int. Cl.[7] ..... H01R 13/58
(52) U.S. Cl. ..... 439/472; 439/578; 439/470; 439/464
(58) Field of Search ..... 439/455, 459–460, 439/464, 470–472, 578–585

(56) References Cited

U.S. PATENT DOCUMENTS

| | | | | |
|---|---|---|---|---|
| 3,885,853 A | | 5/1975 | Reimer | |
| 4,200,962 A | | 5/1980 | Niedecker | |
| 4,408,821 A | * | 10/1983 | Forney, Jr. | 439/387 |
| 4,518,819 A | | 5/1985 | Larsson et al. | |
| 4,571,013 A | | 2/1986 | Suffi et al. | |
| 4,840,581 A | * | 6/1989 | Leufert et al. | 439/472 |
| 4,883,397 A | | 11/1989 | Dubost | |
| 4,902,248 A | * | 2/1990 | Robertson | 439/610 |
| D344,449 S | | 2/1994 | Ward | |
| 5,905,231 A | | 5/1999 | Houte et al. | |
| 5,921,143 A | | 7/1999 | Castillo et al. | |
| D425,127 S | | 5/2000 | Mackey | |
| 6,274,813 B1 | | 8/2001 | Houte | |
| 6,354,879 B1 | * | 3/2002 | Plehaty | 439/610 |
| 6,412,149 B1 | | 7/2002 | Overberg | |
| 6,598,906 B2 | | 7/2003 | Brugmann | |
| 6,824,403 B2 | * | 11/2004 | Hall et al. | 439/108 |

FOREIGN PATENT DOCUMENTS

| | | |
|---|---|---|
| EP | 377377 | 12/1989 |
| WO | 96/13876 | 5/1996 |
| WO | 99/61831 | 12/1999 |

* cited by examiner

*Primary Examiner*—Truc Nguyen
(74) *Attorney, Agent, or Firm*—Kenneth H. Jack; Davis & Jack, L.L.C.

(57) ABSTRACT

An electrical connector including an adapter, having an electric component attachment flange and a hollow bored nipple which is continuous with the adapter, the nipple having an outwardly opening "C" band receiving channel; an electrical cable extending through the nipple; a tubular sheath having a forward end overlying the hollow bored nipple's outwardly opening "C" band receiving channel; a first steel "C" band overlying the flexible tubular sheath, the first steel "C" band being positioned along the flexible tubular sheath so that it further overlies the outwardly opening "C" band receiving channel, the first steel "C" band extending the flexible tubular sheath into the outwardly opening "C" band receiving channel; and at least a second steel "C" band oppositely overlying the first steel "C" band.

8 Claims, 3 Drawing Sheets

ELECTRICAL CONNECTOR

FIELD OF THE INVENTION

This invention relates to electrical connection or coupling devices or assemblies comprising electric cables, a protective flexible sheathing or tubular armoring sleeve, and a cable terminating adapter shell.

BACKGROUND OF THE INVENTION

Constant force spring electrical connection adapter assemblies are known. Such assemblies typically comprise a hollow bored adapter shell for cable termination. Such adapter shells typically comprise a body portion having forward and rearward ends, the forward end of the body portion being adapted for removable attachment to an electrical component housing or to an electric junction box, and the rearward end of the body portion being adapted for removable attachment to a protective cable sheathing. Such forward adaptation typically comprises a helically threaded rotatable coupling nut or an outwardly extending mounting flange having mounting screw receiving apertures or slots. The rearward adaptation of such hollow bored adapter typically comprises a cylindrical nipple having a circular lateral cross sectional shape and having an outwardly opening constant force spring receiving channel.

In use of such constant force spring adapter, the nipple is nestingly extended into an open end of a flexible cable sheathing causing the sheathing to overlie the nipple's outwardly opening channel. Thereafter, a constant force spring (also known as a negator or Hunter spring) is spirally wrapped about the nipple and about the sheathing so that such spring flexibly compresses the sheathing radially inward into the outwardly opening channel. The inward compression securely annularly attaches the sheathing to the nipple. Graphic depictions of the constant force spring assembly described above appear in U.S. Pat. No. 4,902,248 issued on Feb. 20, 1990 to Robertson, et al.

A drawback or deficiency of such constant force spring adapter and sheathing assemblies is that the cross sectional shape of the nipple is restricted to circular. Where the nipple has, for example, a non-circular oval square or rectangular shape, a circular constant force spring wrapped thereabout will undesirably press the sheathing into the outwardly opening channel only at discreet contact points, as opposed to continuous annular compression, resulting in an insecure attachment of the sheath.

Shrink ring adapter assemblies are configured similarly with constant force spring adapter assemblies, as described above. As in constant force spring adapters, the forward end of the body portion of a shrink ring adapter comprises a coupling nut or mounting flange, and the rearward end comprises a nipple having an outwardly opening shrink ring receiving channel. A drawback or deficiency of shrink ring adapters it that shrink rings cannot be installed to overlie a sheath and nipple without extending such ring over the length of the sheathed cable or over the adapter. Often, such extension of a heat shrink ring is mechanically blocked by cable or backshell structures. A drawback or deficiency of such shrink ring adapter assemblies relates to the dimensions of the channel defining annular walls which outwardly extend from the nipple. In order to assemble such shrink ring adapter, a shrink ring must initially overlie and be slidably moveable longitudinally over the combined outside diameters of the sheath and such annular wall. Accordingly, the inside diameter of the shrink ring must initially be sufficiently large to allow such slidable movement. As a result of such geometry, a large percentage of shrinkage needed for such shrink ring to effectively compress the flexible sheath into the outwardly opening channel is dedicated to spanning the radial height of such annular wall. Heat shrink ring shrinkage needed for effective sheath compression and attachment does not commence until after occurrence of shrinkage needed to accommodate passage of the ring over such obstacles. Where a circular shrink ring is utilized for attaching a sheathing to an adapter having a non-circular nipple, such drawbacks and deficiencies are aggravated, requiring initial shrinkage to accommodate both the geometries of ridge and sheath structures and the non-circular nipple shape.

The instant inventive electrical connector assembly overcomes the drawbacks and deficiencies of both the above described constant force spring adapter assembly and shrink ring adapter assembly by utilizing a first and at least a second steel "C" band. Such bands effectively replace the above described constant force spring, and the heat shrink ring, providing mechanical benefits and advantages of both while avoiding drawbacks and deficiencies of both.

BRIEF SUMMARY OF THE INVENTION

A major structural component of the instant inventive electrical connector assembly comprises a hollow bored adapter having a forward end and a rearward end. Preferably, the forward end of the hollow bored adapter is configured to include attaching means suitable for detachably connecting the adapter to electric contact terminals upon an electronic component housing or upon an electric junction box. Where the hollow bored adapter has a circular cylindrical geometry, such attaching means commonly comprises a helically threaded rotatable coupling nut, fixed helical threads, or comprises mounting lugs and lug receiving "L" channels. Where the hollow bored adapter has a non-circular geometry such as a square sided box, the forward end attaching means suitably comprises an outwardly extending mounting ridge or flange including screw receiving apertures, or is configured to engage mounting clips.

The rearward end of such hollow bored adapter preferably forms a rearwardly extending hollow bored nipple whose bore is continuous with the hollow interior of the adapter. Such rearwardly extending nipple preferably presents a radially outwardly opening "C" band receiving channel, such channel preferably being defined by forward and rearward annular ridges which extend radially outward. Preferably, annular outer surfaces of such forward and rearward annular walls along with the floor of the "C" band receiving channel are knurled or ridged for enhanced frictional contact with flexible cable sheathing.

A further structural component of the instant inventive electrical connector assembly comprises at least one electric cable, and preferably a bundle of electric cables, extending through the hollow bore of the nipple, the cables being terminated for electrical connections at the forward end of the hollow bored adapter.

A further structural component of the instant inventive electrical connector assembly comprises a flexible sheathing annularly overlying and extending along the cable, the forward end of such sheath overlying the outwardly opening "C" band receiving channel of the nipple. Typically, the sheathing comprises a wire braid. Suitably, the sheathing may alternately comprise polymer braid, glass fiber braid, or polymer tubing.

A further structural component of the instant inventive assembly comprises a first, and at least a second steel "C" band. Preferably, the steel "C" band has a high elastic limit and is resistant to brittle fractures. Also, the length of such band's longitudinal, forward to rear, dimension preferably equals the longitudinal dimension of the nipple's "C" band receiving channel, less a distance equal to three to five thicknesses of the wall of the flexible sheath. Also, preferably, each steel "C" band has a lateral cross-sectional profile which approximates the lateral cross-sectional profile of the nipple.

In assembling the instant inventive electrical connector, electric cables are extended through the bore of the nipple for completion of secure electrical contacts within the backshell housing. The flexible sheath is contemporaneously extended forwardly over the nipple's outer peripheral surface so that the forward end of the sheath overlies the outwardly opening "C" band receiving channel. Thereafter, a first steel "C" band configured as described above, is pressed over the sheath, such band flexibly extending the sheath radially inward into the "C" band receiving channel. Thereafter, a second steel "C" band configured as described above, is pressed in an opposite direction over the first steel "C" band, such second steel "C" band further flexibly extending the sheath into the channel, and such second steel "C" band securing the first steel "C" band against radial splaying. Suitably, a third steel "C" band may be oppositely pressed over the second.

Upon application of a rearward pulling force to the sheath, the sheath tends to bind between the rearward wall of the "C" band receiving channel and the rearward edges of the first and second steel "C" bands, effectively frictionally securing the sheath upon the nipple.

While the steel "C" bands of the instant invention may suitably be circularly configured and applied for mounting of sheaths upon circular nipples, such bands are most advantageously configured for mounting of sheaths upon non-circular nipples.

Accordingly, objects of the instant invention include the provision of a sheathed cable and backshell adapter combination wherein the forward end of the sheath is fixedly mounted by means of oppositely overlapping steel "C" bands.

Other and further objects, benefits, and advantages of the instant invention have been described above, and further appear and are described in the Detailed Description which follows, and in the appended drawings.

DETAILED DESCRIPTION OF A PREFERRED EMBODIMENT

Figure 1:
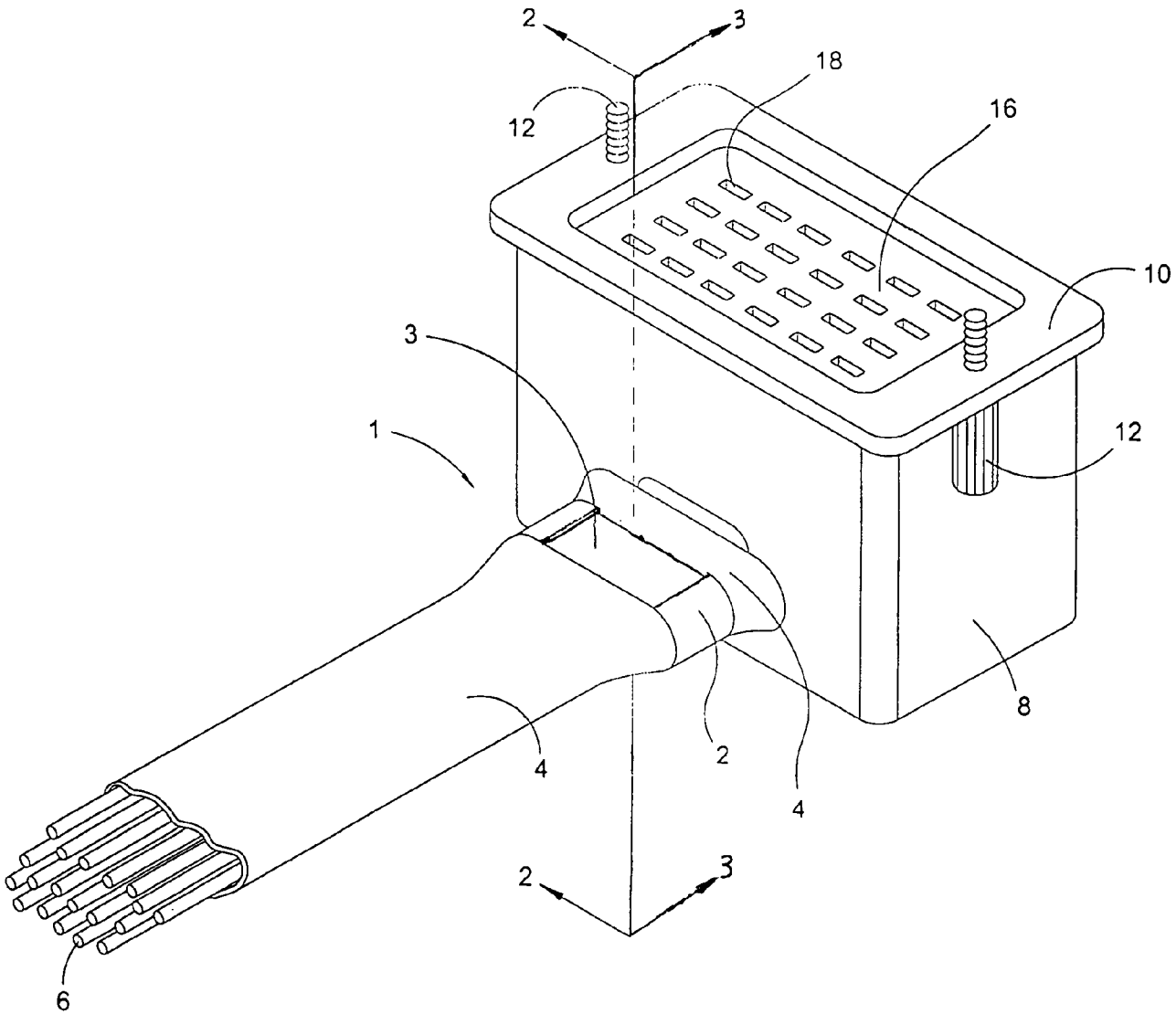
FIG. 1 is an isometric view of a preferred embodiment of the instant inventive electrical connector.

Referring now to the drawings, and in particular to FIG. 1, the instant inventive electrical connector is referred to generally by Reference Arrow 1. The electrical connector 1 comprises a hollow bored adapter housing 8, such housing having an outwardly extending mounting flange 10 supporting mounting screws 12.

Figure 2:
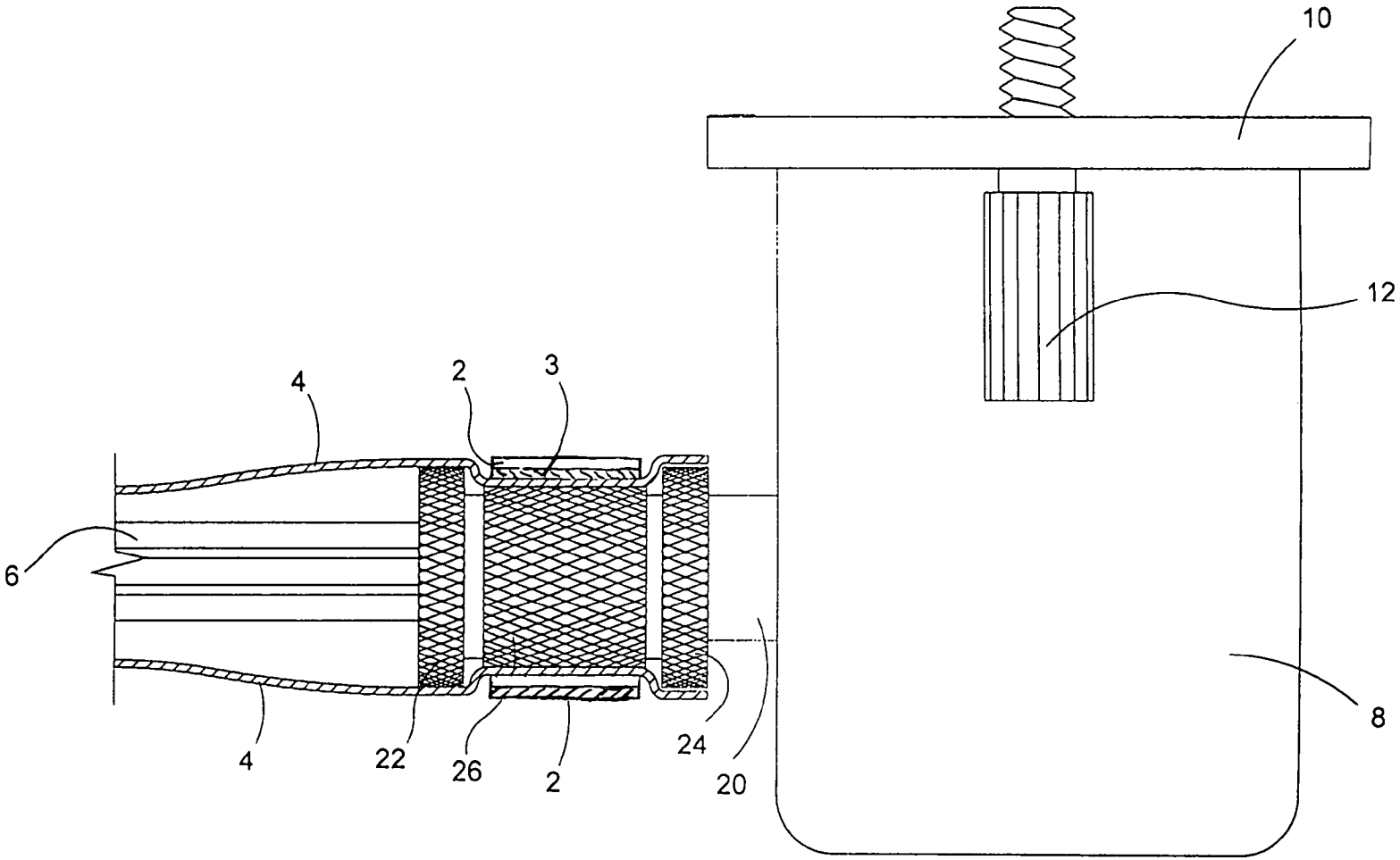
FIG. 2 is a sectional view as indicated in FIG. 1.
Figure 3:
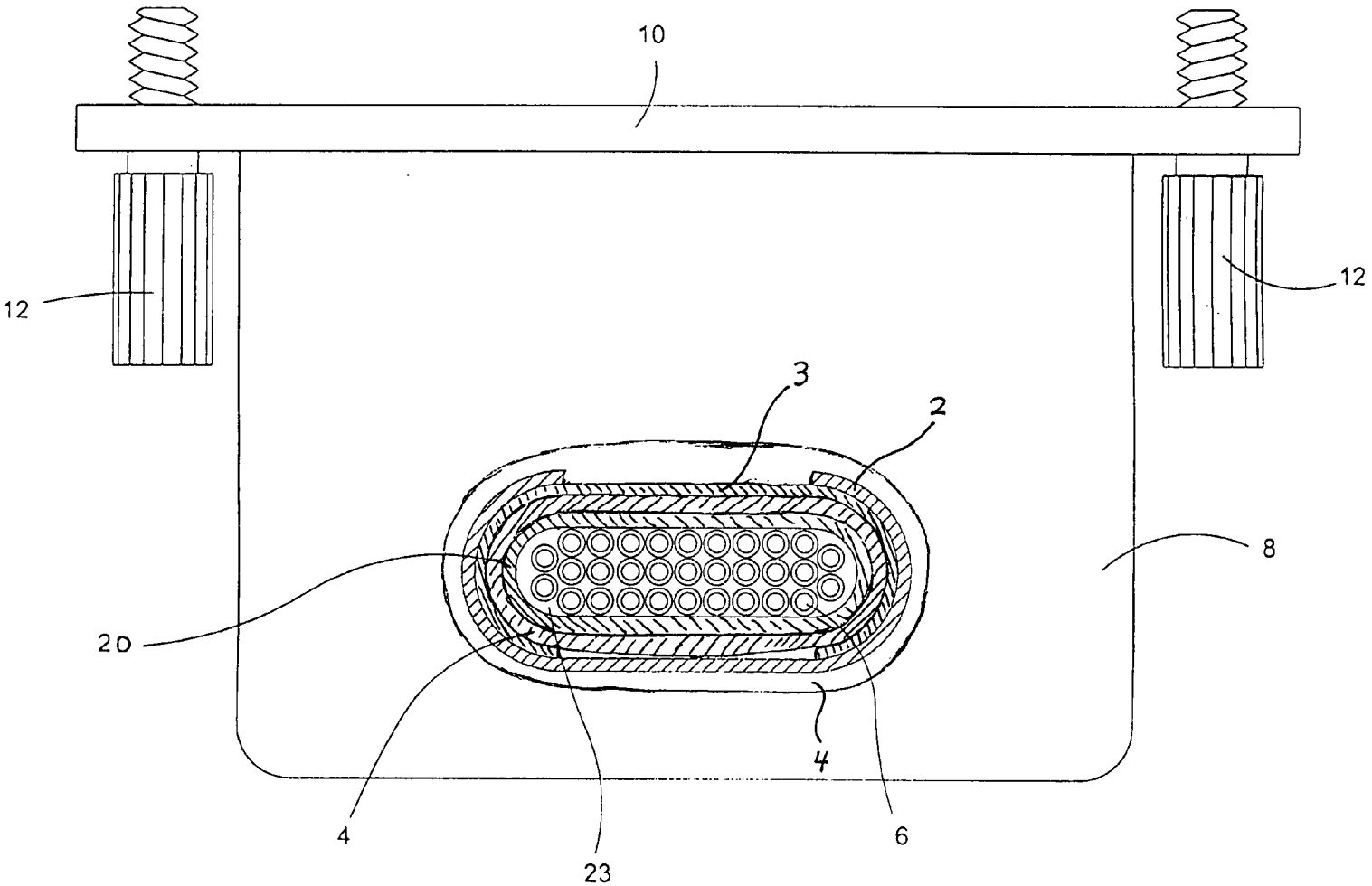
FIG. 3 is an alternate sectional view as indicated in FIG. 1.

Referring simultaneously to FIGS. 1 and 2, a hollow bored nipple 20 extends rearwardly from the housing 8. A bundle of electrical cables 6 extends forwardly through, referring further to FIG. 3, the hollow bore 23 of nipple 20, and thence through the interior of housing 8 for fixed electrical contacts with electrical terminals 18 at terminal plate 16.

Referring simultaneously to all figures, walls 22 and 24 extend radially outward from nipple 20, such walls defining a "C" band receiving channel 26. Preferably, the floor of the "C" band receiving channel 26 is knurled. Also preferably, the outer surfaces of walls 22 and 24 are knurled.

A protective flexible tubular sheath 4 encases cable bundle 6 and extends forwardly to overlie nipple 24. Preferably, sheath 4 comprises a woven wire braid. The knurled surfaces of walls 22 and 24, and of the floor of channel 26 enhances frictional contact against the inner surface of sheath 4 for resistance to rearward sliding.

Referring further simultaneously to all figures, the flexible sheath 4 is securely mounted upon nipple 20 by a first steel "C" band 3, and by an oppositely mounted second steel "C" band 2. Preferably, both steel "C" bands 2 and 3 in their relaxed positions have lateral profiles which closely approximate the lateral profile of nipple 20.

Referring further simultaneously to all figures, upon installation and mounting of steel "C" bands 2 and 3 as depicted, and in the event of an application of a rearward pulling force to sheath 4, frictional contacts between the surfaces of wall 22 and the floor of channel 26 resist such pulling force. As such pulling force is applied, "C" band 2 effectively resists radial splaying of steel "C" band 3.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An electrical connector comprising:

(a) a hollow bored adapter having a forward end and a rearward end, the forward end comprising electrical component attaching means, the rearward end comprising a hollow bored nipple, the hollow bore of the nipple being continuous with the hollow bore of the adapter, the hollow bored nipple having an outwardly opening "C" band receiving channel;

(b) at least a first electrical cable extending within the bore of the hollow bored adapter, and extending through the bore of the hollow bored nipple, the at least first electric cable extending rearwardly from the rearward end of the hollow bored adapter;

(c) a flexible tubular sheath having a forward end overlying the hollow bored nipple's outwardly opening "C" band receiving channel, the flexible tubular sheath extending rearwardly from the rearward end of the hollow bored adapter;

(d) a first steel "C" band overlying the flexible tubular sheath, the first steel "C" band being positioned along the flexible tubular sheath so that it further overlies the outwardly opening "C" band receiving channel, the first steel "C" band extending the flexible tubular sheath into the outwardly opening "C" band receiving channel; and (e) at least a second steel "C" band oppositely overlying the first steel "C" band.

2. The electrical connector of claim 1 wherein the hollow bored nipple has a non-circular cross-sectional shape.

3. The electrical connector of claim 2 wherein the hollow bored nipple has a lateral profile, wherein the first and at least second steel "C" bands have lateral profiles, and wherein the lateral profiles of the first and at least second steel "C" bands approximate that of the hollow bored nipple.

4. The electrical connector of claim 3 wherein the outwardly opening "C" band receiving channel has a rearward end defined by a first outwardly extending wall, said wall having a knurled or ridged outer surface.

5. The electrical connector of claim 4 wherein the outwardly opening "C" band receiving channel has a knurled or ridged floor.

6. The electrical connector of claim 5 wherein the outwardly opening "C" band receiving channel has a forward end defined by a second outwardly extending wall.

7. The electrical connector assembly of claim 1 wherein the electrical component attaching means comprises a connector selected from the group consisting of mounting flanges, rotatable coupling nuts, helical threads, mounting lugs, mounting lug receiving slots, and mounting clips.

8. The electrical connector assembly of claim 7 wherein the flexible tubular sheath comprises a material selected from the group consisting of metal wire braid, polymer fiber braid, glass fiber braid, and polymer tubing.

* * * * *